United States Patent [19]

Kwok

[11] Patent Number: 4,684,064

[45] Date of Patent: Aug. 4, 1987

[54] CENTRIFUGAL ATOMIZER

[75] Inventor: Kui-Chiu Kwok, Arden Hills, Minn.

[73] Assignee: Graco Inc., Minneapolis, Minn.

[21] Appl. No.: 766,526

[22] Filed: Aug. 19, 1985

[51] Int. Cl.[4] ..... B05B 3/10

[52] U.S. Cl. ..... 239/223; 239/224

[58] Field of Search ..... 239/700–703, 239/223, 224

[56] References Cited

U.S. PATENT DOCUMENTS

| | | | |
|---|---|---|---|
| 3,063,642 | 11/1962 | Point | 239/223 X |
| 3,850,373 | 11/1974 | Grolitsch | 239/499 |
| 4,214,708 | 7/1980 | Lacchia | 239/703 |
| 4,405,086 | 9/1983 | Vetter | 239/224 |
| 4,458,844 | 7/1984 | Mitsui | 239/703 |
| 4,505,430 | 3/1985 | Rodgers et al. | 239/223 X |
| 4,519,549 | 5/1985 | Yokoe et al. | 239/703 |

FOREIGN PATENT DOCUMENTS

| | | | |
|---|---|---|---|
| 88525 | 9/1983 | European Pat. Off. | 239/223 |
| 1177045 | 8/1964 | Fed. Rep. of Germany | 239/701 |

*Primary Examiner*—Andres Kashnikow
*Assistant Examiner*—Daniel R. Edelbrock
*Attorney, Agent, or Firm*—Paul L. Sjoquist

[57] ABSTRACT

Centrifugal atomizer head for connection to a high speed rotary atomizer, having an outer disk for receiving and atomizing liquid, and a central disk fitted over the outer disk so as to create an annular liquid passage therebetween, the central disk having a central recess with a plurality of openings through the recess to receive liquid for passage into the recess and over the central disk and over the outer disk.

12 Claims, 4 Drawing Figures

CENTRIFUGAL ATOMIZER

BACKGROUND OF THE INVENTION

The present invention relates to centrifugal atomizers, preferably in the art of spraying liquid coatings, and including centrifugal atomizers incorporating electrostatic techniques in their operation.

Centrifugal atomizers are particularly adaptable for applying certain liquid coating materials, as the atomizers may be designed to create very small liquid particles or droplets, and such fine droplets create a very smooth coating finish. Centrifugal atomizers using electrostatic techniques offer further advantages in particle size control, and in increased efficiencies of applying the coating material which is atomized under the influence of centrifugal and electrostatic forces.

Centrifugal atomizers are conventionally designed in either of two atomization head configurations. In one configuration, the atomization head takes the form of a disk or a dish-shaped device, and in the other case the atomization head takes the form of a cup or bell-shape. In both cases, the atomizing head is affixed to a shaft which is rotatable at relatively high rotating speeds by a rotating drive mechanism. In both cases the coating material or other liquid is metered onto the rotating atomizing head surface, where it is centrifugally, and in some cases electrostatically, propelled from the surface toward an article to be coated. A coating material feed tube or passage is coupled to a source of coating material and leads to an opening proximate the atomizing head, so that coating material which is metered through the tube or passage is captured by the rotating surface, wherein the centrifugal forces may be applied to it.

The atomizing head of the centrifugal atomizer may be rotated at speeds ranging from a few thousand revolutions per minute (rpm) to in excess of 70,000 rpm. Coating material or liquid which is applied to the rotating surface becomes evenly distributed over the entire surface and centrifugal forces cause a generally radial flow outwardly toward an outer edge of the atomizing head. At the outer edge of the atomizing head the coating material is changed from a thin liquid film into a fine droplet cloud, and this cloud of droplets is directed toward the article to be coated. Electrostatic forces may be utilized to assist in the directional motion of the particles, or external air jets may be used for the same purpose.

Because of the high rotational speeds of the atomization head, air movement is created in the region proximate the front of the atomization head. This air moves about the axis of the atomization head in a cyclonic manner, thereby creating at the center region of the atomization head at least a partial vacuum, or a region of reduced pressure. This partial vacuum tends to draw some atomization particles into the center region of the atomization head, and the particles become deposited upon the central front face of the atomization head. If these particles are permitted to collect and to become dry, they will eventually break away from the center region and become incorporated into the atomization spray which is directed toward the article to be finished. If these dried particles are deposited upon the article they create flaws in the finish coating. It is therefore desirable that the atomization head of a centrifugal atomizer be designed so as to prevent the accumulation of dried particles on the central face of the atomization head, to eliminate the possibility of such particles becoming ultimately deposited upon the article to be finished.

SUMMARY OF THE INVENTION

The invention comprises an atomization head for attachment to a centrifugal atomizer for a liquid sprayer, preferably a sprayer for atomizing and applying liquid coating materials. The atomization head preferably includes a dish-shaped or cup-shaped rotatable member having a forwardly projecting circumference and a smooth inner surface leading to an annular liquid feeding orifice which is concentrically placed about the axis of rotation of the atomization head. The atomization head further includes a central disk which has an axial recess, with a plurality of openings through the bottom of the recess to create liquid flow paths to the rear of the atomizer head. A liquid feed chamber is developed at the rear of the atomization head, with a liquid feed orifice positioned proximate the recess openings so as to cause at least a portion of the liquid metered through the orifice to pass through the recessed openings. A further portion of the liquid feeds through the annular passage described above, to develop a first liquid sheet feeding through the annular orifice over the forward surface of the atomization head, and a second liquid sheet feeding through the recessed openings over the forward surface of the concentric disk, thereby continuously wetting the central region of the atomization head and preventing the accumulation of dried particles. A further aspect of the invention includes a diffuser screen which is affixed in covering relation over the central recess of the atomization head, thereby providing further diffusion for liquid passing through the recessed openings, and onto the outer forward surface of the concentric disk.

It is the principal object of the present invention to provide an atomization head for centrifugal sprayers wherein a thin liquid film is metered over the forward surface of the atomization head to provide continuous wetting of the entire forward surface.

It is the further object of the present invention to provide an atomization head having a primary annular metering orifice to the front surface of the atomization head, and a secondary central metering orifice to provide liquid flow to the central portion of the atomization head.

It is a further object of the present invention to provide a diffuser screen over the central recess of an atomization head, through which liquid is both metered and diffused.

BRIEF DESCRIPTION OF THE DRAWINGS

The foregoing and other advantages and objects will become apparent from the following specification and claims, and with reference to the appended drawings, in which:

DESCRIPTION OF THE PREFERRED EMBODIMENT

Figure 1:
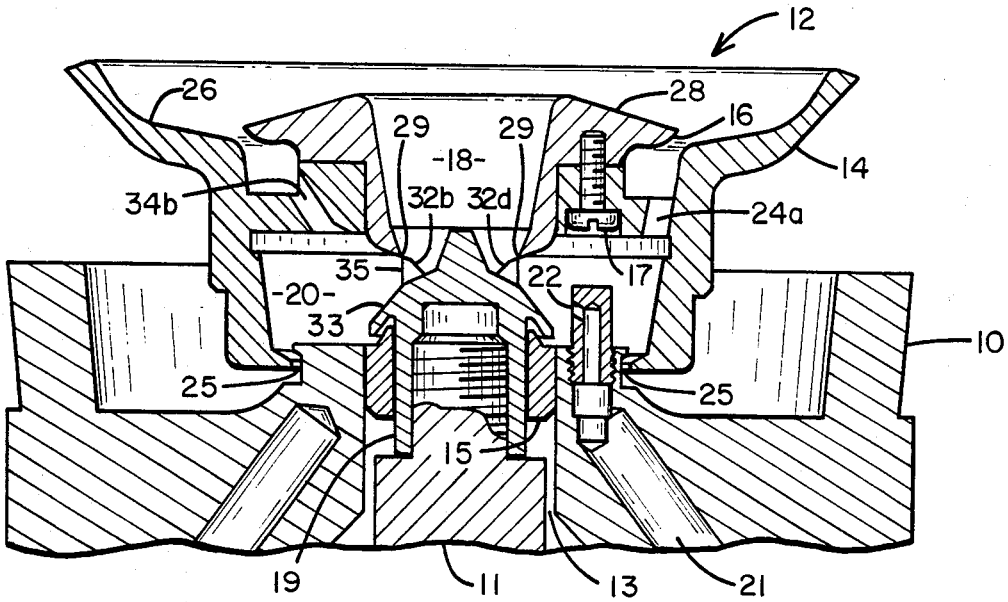
FIG. 1 shows a cross-sectional view of a sprayer having the inventive features incorporated therein.

Referring first to FIG. 1 there is shown a cross-sectional view of a centrifugal atomizer incorporating the inventive features therein. A sprayer body 10 encloses the rotating drive means and other functional elements of the centrifugal atomizer. A rotating member 11 is connected to the drive means to cause rotation about an axis which is generally vertically aligned in FIG. 1. A central disk 16 is threadably attached to rotating member 11 to rotate therewith, and an outer rotating disk 14 is affixed to central disk 16 by fastener 17. Therefore, the atomization head assembly 12, comprising outer disk 14 and central disk 16 rotate together with rotating member 11.

Rotating member 11 passes through an axial opening 13 in sprayer body 10. A seal 15 is pressed into axial opening 13 to provide a liquid seal about the lower shank 19 of central disk 16. Shank 19 is sized so as to be freely rotatable inside of seal 15, there being a small circumferential clearance therebetween. A liquid feed passage 21 passes through sprayer body 10, opening through a feed orifice 22 into a feed chamber 20. Feed chamber 20 is created in the interior of rotating disk 14 for purposes to be hereinafter described.

Figure 4:
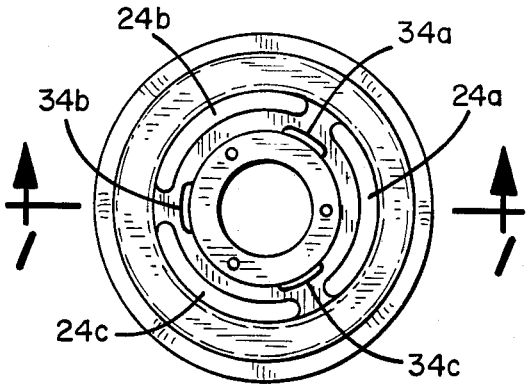
FIG. 4 shows a view taken along the lines 4—4 of FIG. 2.

For purposes of comparison, the cross-sectional view of FIG. 1 is taken across lines 1—1 of FIG. 4. It is apparent that an annular passage comprising passage sections 24*a*, 24*b* and 24*c* are formed through rotating disk 14. The annular passage segments 24*a*, 24*b* and 24*c* are separated by bridging portions required to maintain structural integrity of rotating disk 14. Secondary passages 34*a*, 34*b* and 34*c* are annular segments formed along an inner radius which is smaller than the radius of annular passages 24*a*–24*c*, and secondary passages 34*a*, 34*b* and 34*c* respectively sweep a rotational angle at least as large as the bridging portions above mentioned. In this manner, a 360° annular passage is created, at two radii, through the rotating disk 14.

Figure 3:
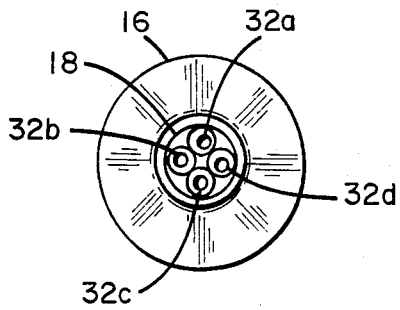
FIG. 3 shows a view taken along the lines 3—3 of FIG. 2.
Figure 2:
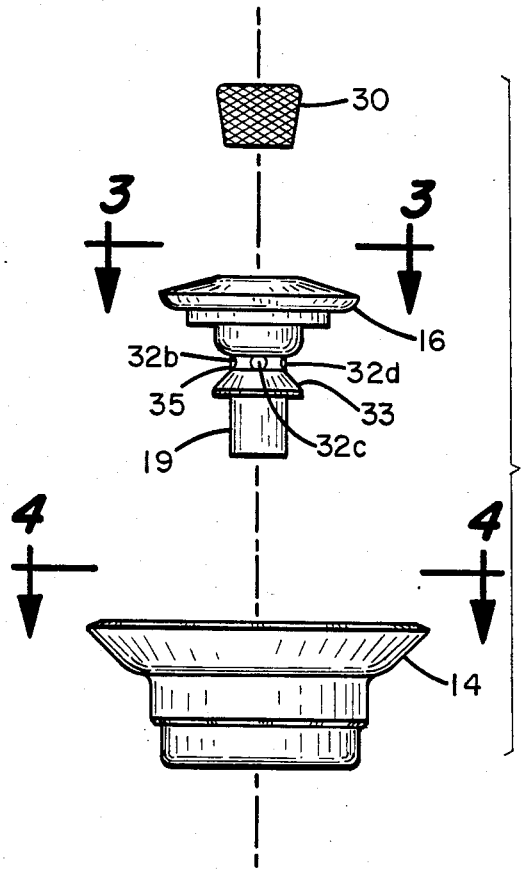
FIG. 2 shows an exploded view of several elements of the invention.

The central disk 16, shown in FIGS. 1, 2 and 3, includes several important constructional features. Lower shank 19 is threadably attached to rotating member 11, and has a smooth exterior surface for providing free rotational motion within seal 15. A rearwardly extending flange 33 is formed to overlay a corresponding upward shoulder in seal 15, in a spaced apart relationship. The combination of flange 33 and seal 15 provide further liquid sealing protection, to prevent liquid from feed chamber 20 from leaking backward into axial opening 13 in sprayer body 10. Immediately above flange 33 is formed a narrowed throat 35, to provide a region of reduced diameter in which to construct openings 32*a*, 32*b*, 32*c* and 32*d*. Each of the openings 32*a*–32*d* is constructed in a two-step drilling process which has the objective of reducing the passage length through central disk 16 to zero. An inward bore is made at throat 35 in a generally upward direction, and a downward bore is made through the bottom of recess 18 to intersect with the inward bore. The combination of these two bores creates each of the openings 32*a*–32*d*, thereby providing zero passage length at the respective intersections of the two bores. This zero passage length is illustrated in FIG. 1 by the sharp edge discontinuity 29 which exists at the intersecting point of the respective two bores. FIG. 3 further illustrates a top view of the intersecting lines of the respective two bores, thereby forming openings 32*a*, 32*b*, 32*c* and 32*d*.

A diffuser screen 30 may be pressfit into axial recess 18, thereby providing diffusion of liquid flowing through axial recess 18 via openings 32*a*–32*d*. In operation, rotating member 11 is rotated at very high rotational speeds, in the range of 20,000–70,000 rpm, causing outer disk 14 and central disk 16 to correspondingly rotate. A liquid, preferably paint, is metered through liquid feed passage 21 and is emitted through feed orifice 22. Some of the liquid from feed orifice 22 is ejected through openings 32*a*–32*d*, to form a film flowing up the interior surface of axial recess 18. This liquid flows upwardly and outwardly over forward surface 28 to constantly wet the forward surface 28. After flowing over forward surface 28, the liquid is centrifugally hurled outwardly onto forward disk surface 26, where it eventually leaves the outer edge as a fine droplet cloud.

Other liquid emitted from liquid orifice 22 accumulates in chamber 20, wherein it is centrifugally ejected through annular passages 24*a*, 24*b* and 24*c*, and also through annular passage segments 34*a*, 34*b* and 34*c*. All this liquid forms a film over forward surface 26, and is ultimately centrifugally atomized via the outer edge of disk 14.

It is therefore apparent that the liquid from the single feed orifice 22 is metered to flow in several directions. A portion of the liquid flows through axial recess 18 and over central disk surface 28 to continuously wet this surface. A further portion of the liquid flows outwardly and forwardly through annular passages 24*a*, 24*b* and 24*c*, to provide a film of liquid over surface 26. A further portion of liquid flows through annular passage segments 34*a*, 34*b* and 34*c* to flow over surface 26 in the manner described above.

Excess accumulations of liquid in chamber 20 escape from containment by chamber 20 through gap 25, which is formed between the lower edge of disk 14 and sprayer body 10.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A centrifugal atomizer head adapted for axial connection to the front end of a high speed centrifugal atomizer rotating member, for atomizing liquid forwardly of said rotating member, comprising (a) a central inner disk assembly having a forwardly facing disk surface, a shank adaptable for axial connection to said rotating member, and a throat section intermediate said forwardly facing disk surface and said shank, and said central inner disk assembly having an axial recess, said recess extending rearwardly from said forwardly facing disk surface to the region of said throat, a plurality of first bores extending rearwardly from the bottom of said recess and a plurality of second bores extending inwardly through said throat section to intersect said first bores, thereby forming passages between said first bores and said second bores, said passages having a sharp edge discontinuity at the intersection of each of said first and second bores to provide a zero length dimension in said passages;

(b) an outer disk affixed to said central inner disk assembly, said outer disk having a forwardly facing surface spaced away from and extending forwardly of said central inner disk forwardly facing surface, said outer disk further having a plurality of annular passage segments placed rearwardly of said central inner disk forwardly facing surface, said outer disk further having a rear section at least partially closing about said central inner disk assembly to form a chamber therebetween; and (c) axially offset means for feeding liquid into said chamber formed between said outer disk and said central inner disk assembly, for causing liquid flow through said plurality of passages passing through said throat section and through said plurality of annular passage segments.

2. The apparatus of claim 1, wherein said plurality of annular passage segments further comprise segments bridging 360° about said axial connection.

3. The apparatus of claim 2, wherein said plurality of annular passage segments further comprise a first plurality of arcuate passages formed at a first radius from said axial connection, and a second plurality of arcuate passages formed at a second radius from said axial connection.

4. The apparatus of claim 3, further comprising a diffuser screen in said axial recess.

5. The apparatus of claim 4, wherein said forwardly facing disk surface has a maximum forward portion forming a smooth contour into said axial recess.

6. The apparatus of claim 5, wherein said axial recess further comprises an interior wall sloping toward said axial connection at its rearward position.

7. In a centrifugal atomizer of the type having a rotatable member for rotating a forwardly facing atomizing head about the axis of the rotatable member and having an axially offset liquid feed tube, the improvement comprising (a) a central inner disk assembly affixed to said rotating member, said inner disk assembly having a reduced throat section and a forwardly facing inner disk surface, and an axial recess in said inner disk surface extending rearwardly proximate said reduced throat section, and a plurality of first bores in said axial recess and a plurality of second bores through said throat section, each of said second bores intersecting one of said first bores to form a sharp edge discontinuity at the intersection;

(b) an outer disk assembly affixed to said inner disk assembly, having a forwardly facing surface spaced from said inner disk forwardly facing surface and extending forwardly therefrom, and having a rear section extending rearwardly of said reduced throat section, and having a plurality of arcuate openings between said forwardly facing surface and said rear section; and (c) an atomizer housing closely fitted adjacent said outer disk assembly rear section to form a chamber enclosed by said housing, said rear section and said inner disk assembly, and a liquid feed tube affixed to said housing and having a liquid feed orifice positioned in said chamber away from said axis.

8. The apparatus of claim 7, wherein said plurality of arcuate openings extend a full 360° about said axis.

9. The apparatus of claim 8, wherein said forwardly facing disk surface has a maximum forward portion forming a smooth contour into said axial recess.

10. The apparatus of claim 9, wherein said axial recess has a first diameter proximate said plurality of first bores and a larger second diameter proximate its forward end.

11. The apparatus of claim 10, wherein said plurality of arcuate openings further comprise a first group of arcuate segments at a first radius from said axis and a second group of arcuate segments at a second radius from said axis.

12. The apparatus of claim 11, further comprising a diffuser screen in said axial recess.

* * * * *